US008548353B2

(12) United States Patent
Wu et al.

(10) Patent No.: US 8,548,353 B2
(45) Date of Patent: Oct. 1, 2013

(54) DEVELOPER CARTRIDGE

(75) Inventors: Jun-Zhong Wu, Guangdong (CN); Ge-Ming Ding, Guangdong (CN)

(73) Assignee: Zhuhai Seine Technology Limited, Guangdong (CN)

( * ) Notice: Subject to any disclaimer, the term of this patent is extended or adjusted under 35 U.S.C. 154(b) by 891 days.

(21) Appl. No.: 12/279,078

(22) PCT Filed: Jul. 25, 2006

(86) PCT No.: PCT/CN2006/001848
§ 371 (c)(1),
(2), (4) Date: Jan. 8, 2009

(87) PCT Pub. No.: WO2007/093089
PCT Pub. Date: Aug. 23, 2007

(65) Prior Publication Data

US 2009/0220269 A1 Sep. 3, 2009

(30) Foreign Application Priority Data

Feb. 13, 2006 (CN) ..... 2006 1 0033540
Mar. 21, 2006 (CN) ..... 2006 1 0065235

(51) Int. Cl.
*G03G 15/00* (2006.01)
*G03G 21/16* (2006.01)

(52) U.S. Cl.
USPC ..... 399/109; 399/126

(58) Field of Classification Search
USPC ..... 399/109, 119, 126
See application file for complete search history.

(56) References Cited

U.S. PATENT DOCUMENTS 6,275,672 B1 * 8/2001 Blum et al. ..... 399/126

FOREIGN PATENT DOCUMENTS

JP 07098523 A * 4/1995

* cited by examiner

*Primary Examiner* — David Gray
*Assistant Examiner* — Erika J Villaluna

(57) ABSTRACT

A developer cartridge is provided, which includes a toner cartridge, a developer stirring device located in the toner cartridge, a supply roller for supplying a developer to a developer roller, a developer roller for developing an electrostatic latent image on a photoconductor, and a power receptor for driving only one of gear sets of the above means to receive a power. The power receptor is rotatably fixed at two or more predetermined positions. An initial position of the power receptor is a power receiving position. A power receptor moving device includes a press block, a baffle block, a spring, and a torsion spring. The power receptor moving device is controlled by the press block. When the press block of the power receptor moving device is pressed downwards, the power receptor is rotated to another power receiving position due to the action of the torsion spring. The present invention is applicable to various types of machines.

9 Claims, 5 Drawing Sheets

DEVELOPER CARTRIDGE

BACKGROUND OF THE INVENTION

1. Field of the Invention

The present invention relates to a developer cartridge applicable to an electronic photographic developing device.

2. Related Art

In an image forming apparatus, such as laser printer, copier, and all-in-one printer, electrostatic latent image is formed on a surface of a photosensitive drum serving as an image carrier, and the electrostatic latent image on the photosensitive drum is then developed by a developer carried on a developing drum serving as a developer carrier of a developing device, so as to form a visible image. The developer image is transferred onto a material to be transferred, and then is fused for output on a transfer material by a fusing device.

A type of image processing unit in prior art includes a photosensitive unit and a developing unit detachably combined with the photosensitive unit. The photosensitive unit at least includes a photosensitive drum and a transfer roller. The developing unit includes a toner cartridge, a stirrer, a supply roller, and a developer roller, and so on. The photosensitive unit and the developing unit of the image processing unit have substantially the same developing principle, internal structure, internal means, and relevant positions of the means. Because manufacturers develop different types of machines, in order to prevent the developer cartridge being installed into an incorrect machine by mistake, different developer cartridges have installation limit blocks corresponding to the type of the machine, and a driving position are located at a corresponding position on a side wall. As the developer cartridges have substantially the same basic structure, but must be separated clearly during production, marketing, and using, otherwise, they cannot be used, thus causing unnecessary social costs to some extent.

SUMMARY OF THE INVENTION

The present invention is directed to a developer cartridge applicable to various image forming apparatus.

Hereinafter, the present invention is illustrated in detail with reference to accompanying drawings.

The present invention provides a developer cartridge, which includes a toner cartridge, a developer stirring device located in the toner cartridge, a supply roller for supplying a developer to a developer roller, a developer roller for developing an electrostatic latent image on a photoconductor, and a power receptor for driving only one of gear sets of the means to receive a power. The power receptor is rotatably fixed at two or more predetermined positions.

In the present invention, an initial position of the power receptor is a power receiving position, a power receptor moving device includes a press block, a baffle block, a spring, and a torsion spring. The power receptor moving device is controlled by the press block. When the press block of the power receptor moving device is pressed downwards, the power receptor is rotated to another power receiving position due to the action of the torsion spring.

In the present invention, the power receptor and a gear 2 are integrated together, and the gear 2 rotates around a shaft secured on a side plate 6. The gear 2 and a gear 3 are fixed oppositely by side plates 6, 7. When the developer cartridge is installed into an image forming apparatus, the power receptor 1 receives a power to drive the gear 2 to rotate, the gear 2 is engaged with the gear 3, and the gear 3 is secured to a gear 4, such that the power is transmitted through the gear 4 in sequence, so as to drive rotation means of a developing apparatus to rotate.

In the present invention, the press block 5 contacts an upper portion 81 of the baffle block 8 through a wedge-shaped surface. When the power receptor 1 is at an initial position shown in the figure, a right portion 82 of the baffle block 8 is located in a depression 10 formed on the side plate 7, such that the gear 2 and the power receptor 1 are fixed at the initial position, and at the same time, a spring 9 is in a stretched state.

In the present invention, when it intends to place the power receptor 2 at a second driving position, the press block 5 is pressed downwards in a direction as shown by arrows, such that the press block 5 acts on the upper portion 81 of the baffle block through the wedge-shaped surface to make the spring 9 contracted, and at the same time, the baffle block 8 is moved and reacted in an arrow direction, and the right portion 82 retreats out of the depression 10. A torsion spring 11 is located on the side plate 6, and has one end placed in a hole of a side plate 6 and the other end leaned against an inner bottom of a baffling plate 12. When the right portion 82 of the baffle block 8 retreats out of the depression (10), an elastic force of the torsion spring 11 acts on the side plate 6, such that the power receptor (1) is rotated to a second driving position, thus completing the operation.

In the present invention, an upper surface of the developer cartridge is actually a plane surface.

The present invention provides a movable driving position by adopting the above technical scheme. When the product leaving the plant, the driving position is at a fixed position at the gear set side, and the driving position can automatically rotate to another position through a simple operation of a customer, thus being applicable to two or more types of machines having two or more different positions. That is to say, the developer cartridge is made to be universal and applicable to various machines, thus significantly saving social resource to some extent. For consumable manufacturers, the molds and production lines for producing different developer cartridges are reduced, and for marketing and customers, a series of unnecessary troubles brought by too many types of developer cartridge are avoided.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

Hereinafter, a developer cartridge according to an embodiment of the present invention is described with reference to FIGS. 1 to 6.

Figure 1:
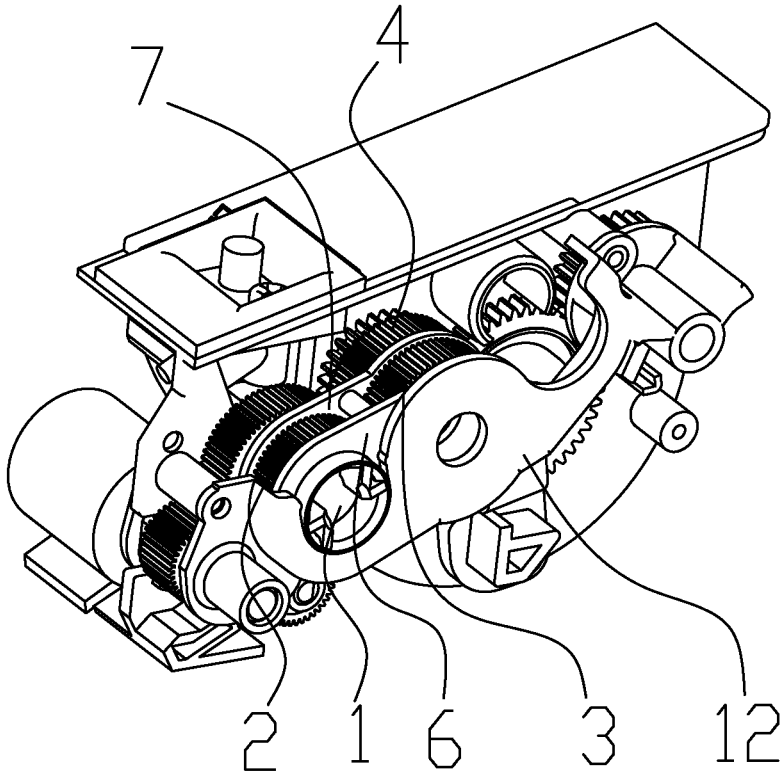
FIG. 1 is an assembly view of a power receptor of the present invention at a first driving position.

As shown in FIG. 1, a power receptor 1 is at an initial position, which is a power receiving position. The power receptor and a gear 2 are integrated together, and the gear 2 rotates around a shaft secured on a side plate 6. The gear 2 and a gear 3 are oppositely fixed by side plates 6, 7. When the developer cartridge is installed into an image forming apparatus, the power receptor 1 receives a power and drives the gear 2 to rotate, the gear 2 is engaged with the gear 3, and the gear 3 is secured to a gear 4, thus the power is transmitted through the gear 4 in sequence, thereby driving the rotation means of a developing device to rotate.

Figure 2:
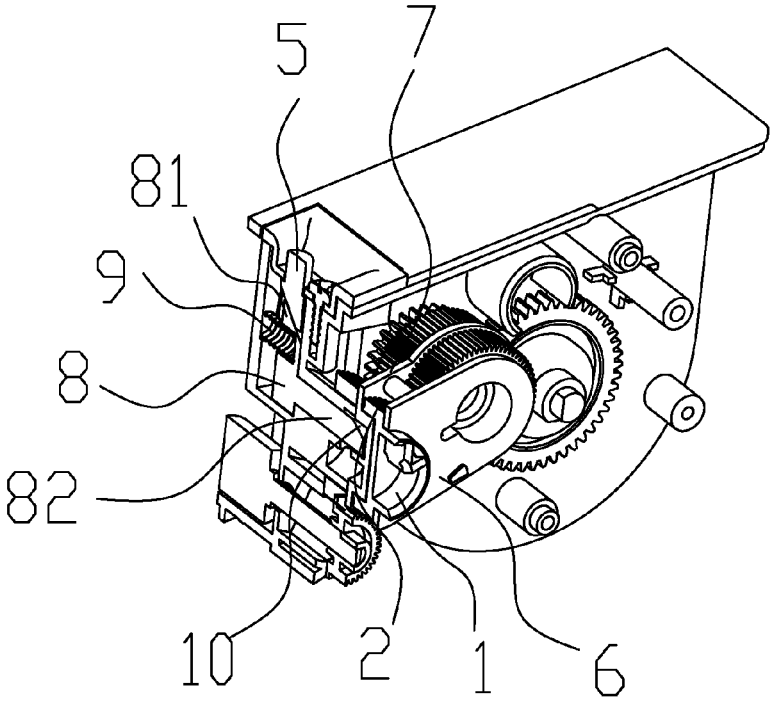
FIG. 2 is a partial cross-sectional view of the power receptor of the present invention at the first driving position.
Figure 3:
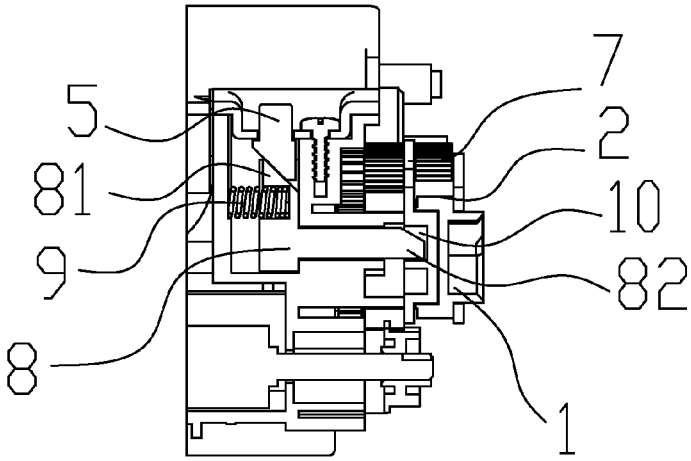
FIG. 3 is a cross-sectional side view of FIG. 2.
Figure 4:
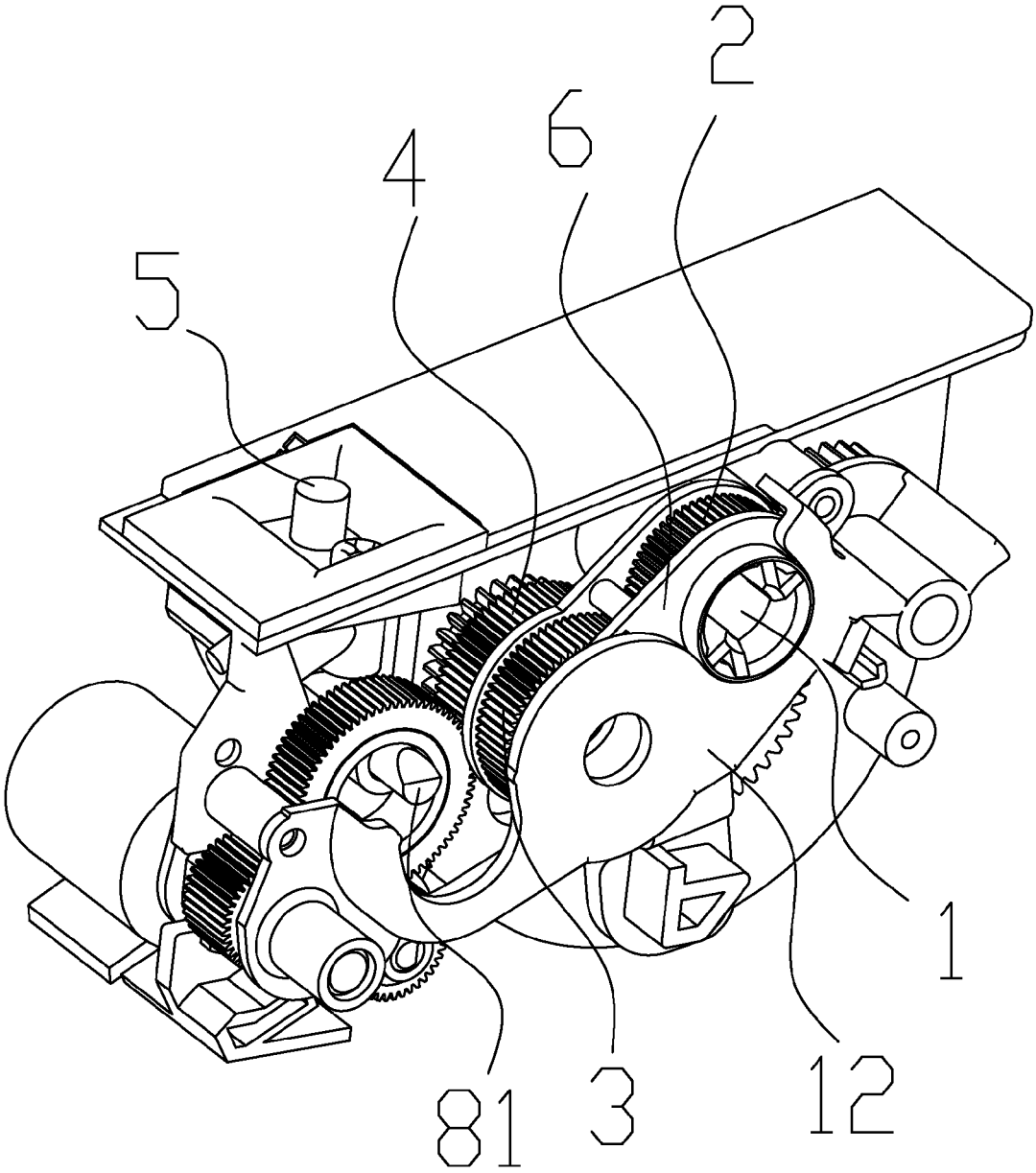
FIG. 4 is an assembly view of the power receptor of the present invention at a second driving position.
Figure 5:
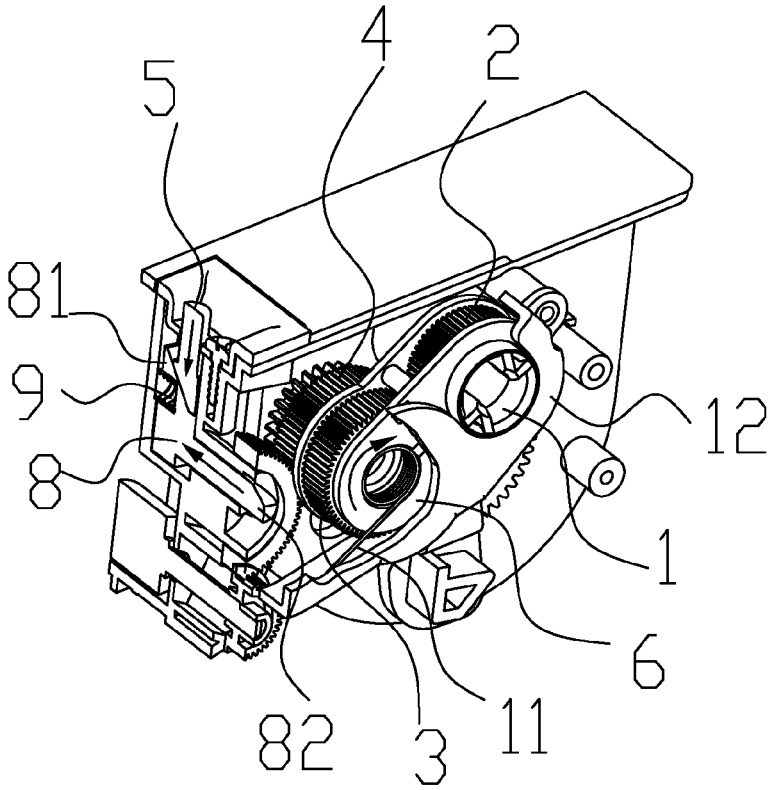
FIG. 5 is a partial cross-sectional view of the power receptor of the present invention at the second driving position.
Figure 6:
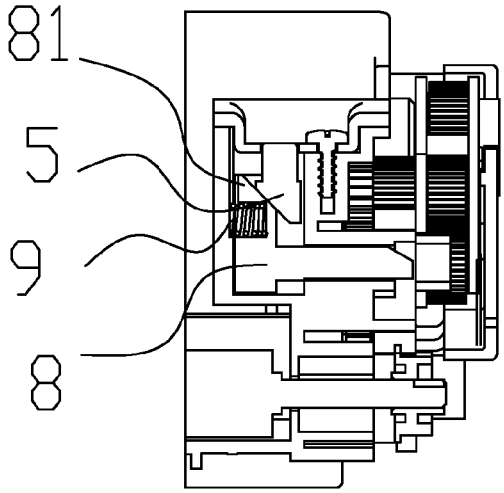
FIG. 6 is a cross-sectional side view of FIG. 5.
Figure 7:
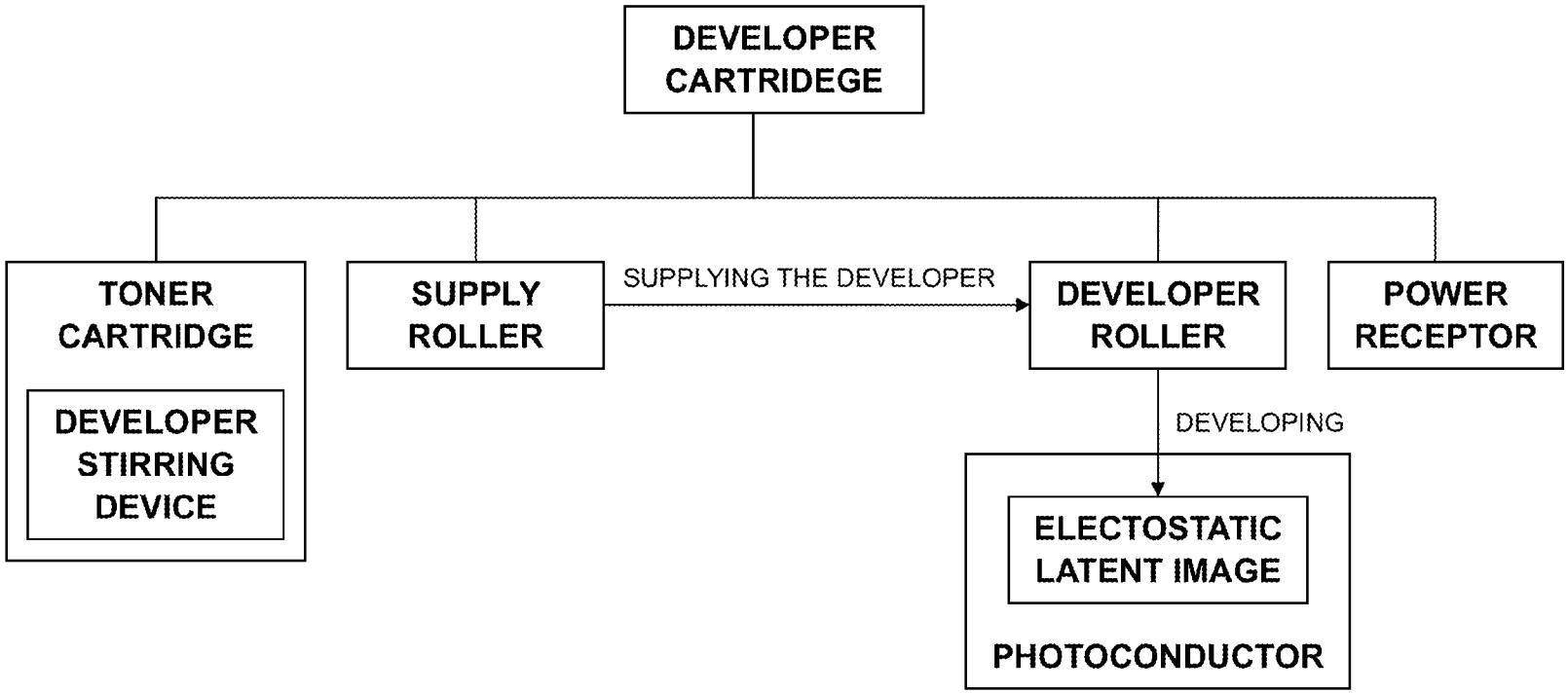
FIG. 7 is a block diagram of an embodiment of the invention.

As shown in FIGS. 2 and 3, in the present invention, a power receptor moving device includes a press block 5, a baffle block 8, and a spring 9. The press block 5 contacts an upper portion 81 of the baffle block 8 through a wedge-shaped surface. When the power receptor 1 is at the initial position shown in the figures, a right portion 82 of the baffle block 8 is located in a depression 10 formed on the side plate 7, such that the gear 2 and the power receptor 1 are fixed at the initial position, and at this time, the spring 9 is in a stretched state As shown in FIGS. 4, 5, and 6, when it intends to place the power receptor 2 at a second driving position shown in the figures, the press block 5 is pressed downwards in a direction shown by arrows, such that the press block 5 acts on the upper portion 81 of the baffle block through the wedge-shaped surface to make the spring 9 contracted. At the same time, the baffle block 8 is moved and reacted in an arrow direction, and the right portion 82 retreats out of the depression 10. A torsion spring 11 is located on the side plate 6, and has one end placed in a hole of the side plate 6 and the other end leaned against an inner bottom of a baffling plate 12. When the right portion 82 of the baffle block 8 retreats out of the depression 10, an elastic force of the torsion spring 11 acts on the side plate 6, such that the power receptor 1 is rotated to the second driving position, thus completing the operation.

What is claimed is:

1. A developer cartridge for detachable connection with a photosensitive unit that includes a photosensitive drum, the developer cartridge comprising:

a toner cartridge;

a developer stirring device, located in the toner cartridge;

a developer roller, for developing an electrostatic latent image on the photosensitive drum;

a supply roller, for supplying developer to the developer roller; and a gear set for driving said developer stirring device, developer roller and supply roller, the gear set including a power receptor for receiving power, wherein the power receptor is rotatably fixable at two or more predetermined positions, an initial position of the power receptor is a power receiving position, and a power receptor moving device comprises a press block, a baffle block, a spring, and a torsion spring, the power receptor moving device is controlled by the press block, and when the press block of the power receptor moving device is pressed downwards, the power receptor is rotated to another power receiving position due to action of the torsion spring.

2. The developer cartridge according to claim 1, wherein the power receptor and a first gear are integrated together, the first gear rotates around a shaft secured on a first side plate, the first gear and a second gear are fixed by the first side plate and a second opposing side plate, and when the developer cartridge is installed into an image forming apparatus, the power receptor receives power to drive the first gear to rotate, the first gear is engaged with the second gear, and the second gear is secured to a third gear, such that the power is transmitted to the third gear in sequence, so as to drive rotation means of a developing device to rotate.

3. The developer cartridge according to claim 2, wherein the press block contacts an upper portion of the baffle block through a wedge-shaped surface, and when the power receptor is at the initial position, a right portion of the baffle block is located in a depression formed on the second side plate, such that the first gear and the power receptor are fixed at the initial position, and at this time, the spring is in a stretched state.

4. The developer cartridge according to claim 3, wherein to place the power receptor at a second driving position, the press block is pressed downwards, such that the press block acts on the upper portion of the baffle block through the wedge-shaped surface to cause the spring to contract, and at the same time, the baffle block is moved and retracted, and the right portion retreats from the depression; a torsion spring is located on the first side plate, and has one end placed in a hole of first side plate and the other end against an inner bottom of a baffling plate, when the right portion of the baffle block retreats from the depression, an elastic force of the torsion spring acts on the first side plate, such that the power receptor is rotated to the second driving position.

5. The developer cartridge according to claim 4, wherein an upper surface thereof is a plane surface.

6. The developer cartridge according to claim 2, wherein to place the power receptor at a second driving position, the press block is pressed downwards, such that the press block acts on an upper portion of the baffle block through a wedge-shaped surface to cause the spring to contract, and at the same time, the baffle block is moved and retracted, and a right portion of the baffle block retreats from a depression in the second side plate; the torsion spring is located on the first side plate, and has one end placed in a hole of the first side plate and the other end against an inner bottom of a baffling plate, when the right portion of the baffle block retreats from the depression, an elastic force of the torsion spring acts on the first side plate, such that the power receptor is rotated to the second driving position.

7. The developer cartridge according to claim 6, wherein an upper surface thereof is a plane surface.

8. The developer cartridge according to claim 1, wherein to place the power receptor at a second driving position, the press block is pressed downwards, such that the press block acts on an upper portion of the baffle block through a wedge-shaped surface to cause the spring to contract, and at the same time, the baffle block is moved and retracted, and a right portion of the baffle block retreats from a depression; the torsion spring is located on a side plate used to secure a shaft of the gear, and has one end placed in a hole of the side plate and the other end against an inner bottom of a baffling plate, and when the right portion of the baffle block retreats from the depression, an elastic force of the torsion spring acts on the side plate, such that the power receptor is rotated to the second driving position.

9. The developer cartridge according to claim 8, wherein an upper surface thereof is a plane surface.

* * * * *